73-151 SR
8/11/87 OR 4,685,329

United States Patent [19]

Burgess

[11] Patent Number: 4,685,329

[45] Date of Patent: Aug. 11, 1987

[54] ASSESSMENT OF DRILLING CONDITIONS

[75] Inventor: Trevor M. Burgess, Missouri City, Tex.

[73] Assignee: Schlumberger Technology Corporation, New York, N.Y.

[21] Appl. No.: 730,695

[22] Filed: May 2, 1985

[30] Foreign Application Priority Data

May 3, 1984 [GB] United Kingdom ..... 8411361

[51] Int. Cl.[4] ..... E21B 44/00; E21B 47/00

[52] U.S. Cl. ..... 73/151; 73/151.5; 175/39

[58] Field of Search ..... 73/151/151.5, 152; 175/39, 40; 364/422

[56] References Cited

U.S. PATENT DOCUMENTS

| | | | |
|---|---|---|---|
| 2,669,871 | 2/1954 | Lubinski | 73/151 |
| 3,581,564 | 6/1971 | Young, Jr. | 73/151 |
| 3,774,445 | 11/1973 | Rundell et al. | 73/151 |
| 3,782,190 | 1/1974 | Pittman | 73/151 |
| 3,898,880 | 8/1975 | Kelseaux et al. | 73/151.5 |
| 3,916,684 | 11/1975 | Rundell | 73/151.5 |
| 4,064,749 | 12/1977 | Pittman | 73/151 |

FOREIGN PATENT DOCUMENTS

| | | |
|---|---|---|
| 3100984 | 7/1982 | Fed. Rep. of Germany . |
| 0156312 | 12/1981 | Japan . |

OTHER PUBLICATIONS

T. M. Warren, Drilling Model for Soft-Formation Bits, J. of Pet. Tech., Jun. 1981, pp. 963-970.

T. M. Warren, "Factors Affecting Torque for a Roller Core Bit" Sep. 1984, pp. 1500-1508, J. of Pet. Tech., vol. 36, No. 10.

Deily et al., New Drilling-Research Tool Shows What Happens Down Hole, 1-8-68, Oil and Gas Journal vol. 492, No. 66, pp. 55-64.

*Primary Examiner*—Jerry W. Myracle
*Assistant Examiner*—Scott M. Oldham

[57] ABSTRACT

In a method of assessing drilling conditions during a drilling operation measurements of torque applied (TOR), weight on bit (WOB), rate of penetration (ROP), and rotation speed (ROT) are gathered. Computed therefrom is a history (60, 61) of points (x, y) where x=(TOR/WOB) and y=(ROP/ROT)$^{\gamma}$: $\gamma$ being a derived constant indicative of down hole geometry. Trends in this history are monitored to assess drilling conditions. For example in soft plastic rock migration 62 towards the origin and in hard plastic rock migration 63 towards the abscissa is indicative of drill bit wear.

6 Claims, 6 Drawing Figures

ASSESSMENT OF DRILLING CONDITIONS

This invention relates to drilling, and in particular to a method of assessing drilling conditions during a drilling operation with a view to identifying trends such as drill bit wear, pore pressure variation, and lithology changes while the drilling operation is in progress.

In drilling, the efficiency and effectiveness of the operation is influenced by changing conditions. To date determination of wear is only possible by removal of the drill bit for inspection. Such inspections constitute an undesirable overhead on drilling operations.

According to the present invention a method of assessing drilling conditions during a hole drilling operation includes the steps of: gathering measurements of torque applied (TOR), weight on bit (WOB), rate of penetration (ROP), and rotation speed (ROT); computing the values $x=(TOR/WOB)$ and $y=(ROP/ROT)^{\gamma}$ for substantially simultaneous samples of TOR, WOB, ROP and ROT; where $\gamma$ is a constant indicative of down hole geometry, building up a history of a plurality of points (x,y) in the (TOR/WOB) versus $(ROP/ROT)^{\gamma}$ plane; and monitoring trends in the history of points (x, y). Preferably the method includes the additional steps of computing values $a=\log(TOR/WOB)$ and $b=\log(ROP/ROT)$ for substantially simultaneous samples of TOR, WOB, ROP and ROT; building up a first history of a plurality points (a,b) in the log (TOR/WOB) versus log (ROP/ROT) plane, and interpreting the first history to identify the constant $\gamma$.

It has been found that by monitoring the first history of points (x, y) a number of features about the drilling conditions may be established. Trends are preferably monitored by computing both the modulus and argument of (x, y) points in the (TOR/WOB) versus $(ROP/ROT)^{\gamma}$ plane and comparing successive values. It has been found, for example that a history of changing modulus at constant argument indicates changing pore pressure conditions. In soft plastic rock decreasing modulus at substantially constant argument indicates drill bit wear, whilst in rock of hard brittle character argument decreases as bit wear occurs.

It will be appreciated that a feature of the present invention is that the method may be machine implemented in real time as drilling is in progress. Thus a check on drilling progress may be kept, and appropriate action taken if adverse trends are established. For example a drill bit may be replaced if excessive wear is indicated.

In accordance with known techniques TOR, WOB, ROP and ROT are preferably measured down hole. Alternatively surface measurements may be employed, and valid trends still established.

In a preferred form of the present invention the method is machine implemented in a computer. A plurality of substantially simultaneous samples of TOR, WOB, ROP and ROT are stored in computer memory and a plurality of values (a, b) computed therefrom. Values (a, b) are stored in computer memory as a history. When a value of $\gamma$ has been reliably established, previous values of TOR, WOB, ROP and ROT are advantageously recalled to compute (x, y) points which contribute to a plurality of points forming the history in addition to subsequent successive computations of (x, y) values.

According to an alternative method of carrying out the present invention a value for the constant $\gamma$ may be available a priori for example from knowledge of previous drilling operations. The history may be derived from (x, y) values computed using the known value of $\gamma$. As successive measurements are gathered, information concerning drilling conditions is built up and advantageously the value of $\gamma$, however initially derived may be updated in the light of a longer history, (x, y) values forming the history recomputed, and trends monitored with an increased level of confidence.

It will be appreciated that if suitable measurements cannot be gathered from instrumentation existing on the drilling rig the operation of which is to be assessed, the invention may include the steps of placement of suitable transducers and transducer signal conditioning and interfacing equipment on the drilling rig. Data processing steps such as standardizing of values for variations in WOB and ROT by applying a correction function to measured values, and inferring a value for down hole torque from a surface measurement may be included.

According to another aspect of the present invention, apparatus for the assessment of drilling conditions includes, instrumentation means for gathering substantially simultaneous measurements of TOR, WOB, ROP and ROT, and machine means for implementing the method of the present invention, as hereinbefore described.

In order that features and advantages of the present invention may be further understood and appreciated, the following examples are presented, with reference to the accompanying diagrammatic drawings, of which:

In order to facilitate the clear presentation of the examples, depth histories of points (a, b) and (x, y) are represented graphically in cartesian form having axes log (TOR/WOB), log (ROP/ROT); (TOR/WOB), $(ROP/ROT)^{\gamma}$ respectively. It will be realized, however that in a machine implemented form of the present invention, the depth histories are advantageously stored in computer memory in tabular form. It will further be realized that computations of a constant exponent, modulus and argument, may be straight forwardly computed from such stored values. For the purpose of clarity these quantities will hereinafter be described as slope, distance from origin, and angle subtended to the abcissa in accordance with the graphical presentation.

Figure 1:
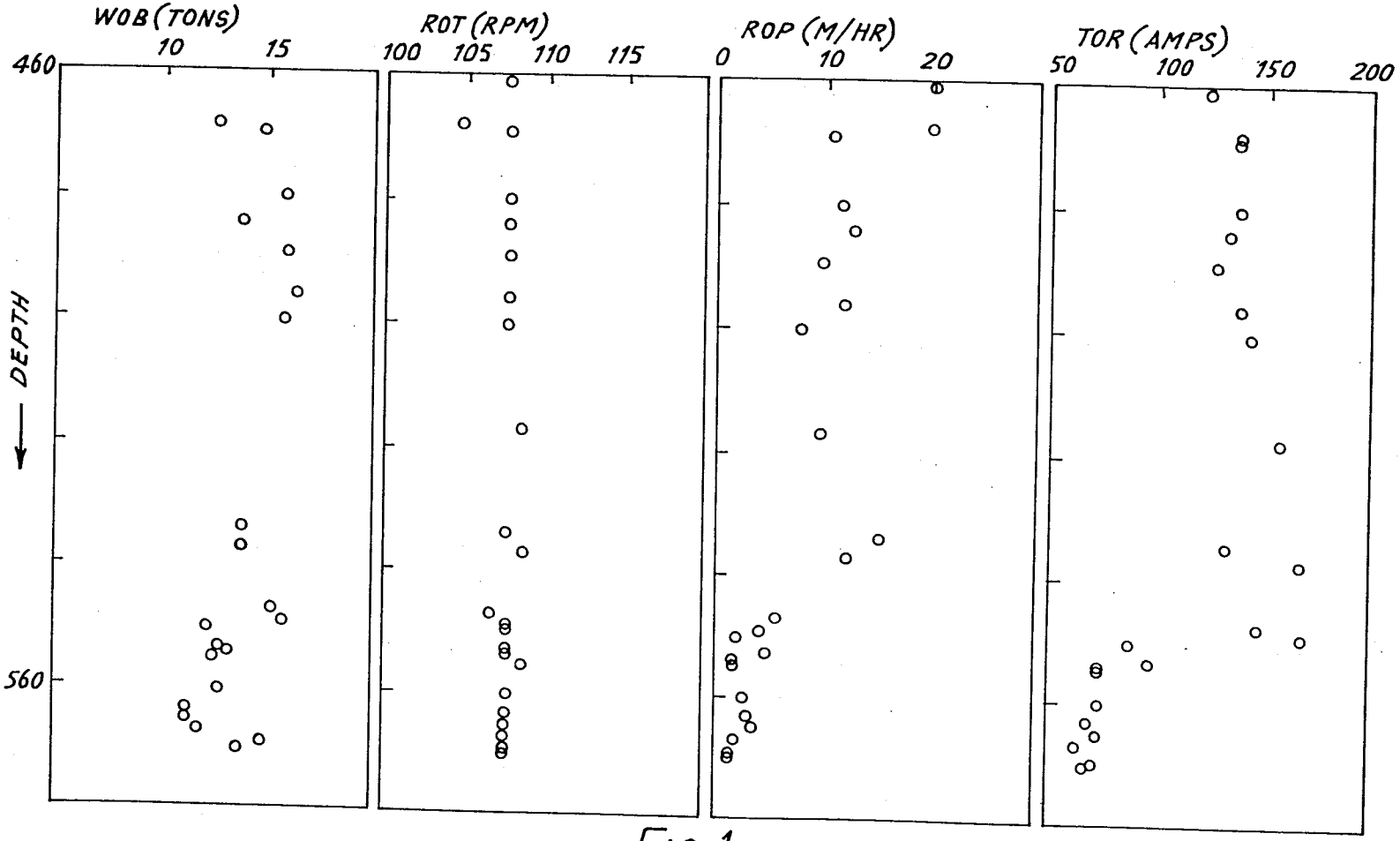
FIG. 1 represents typical measurements gathered during a drilling operation.

FIG. 1 shows the logs of the raw data as recorded throughout a typical drilling operation. The input values of WOB and ROT were fairly constant and are presented against depth. Values of ROP and TOR are also plotted.

Figure 2:
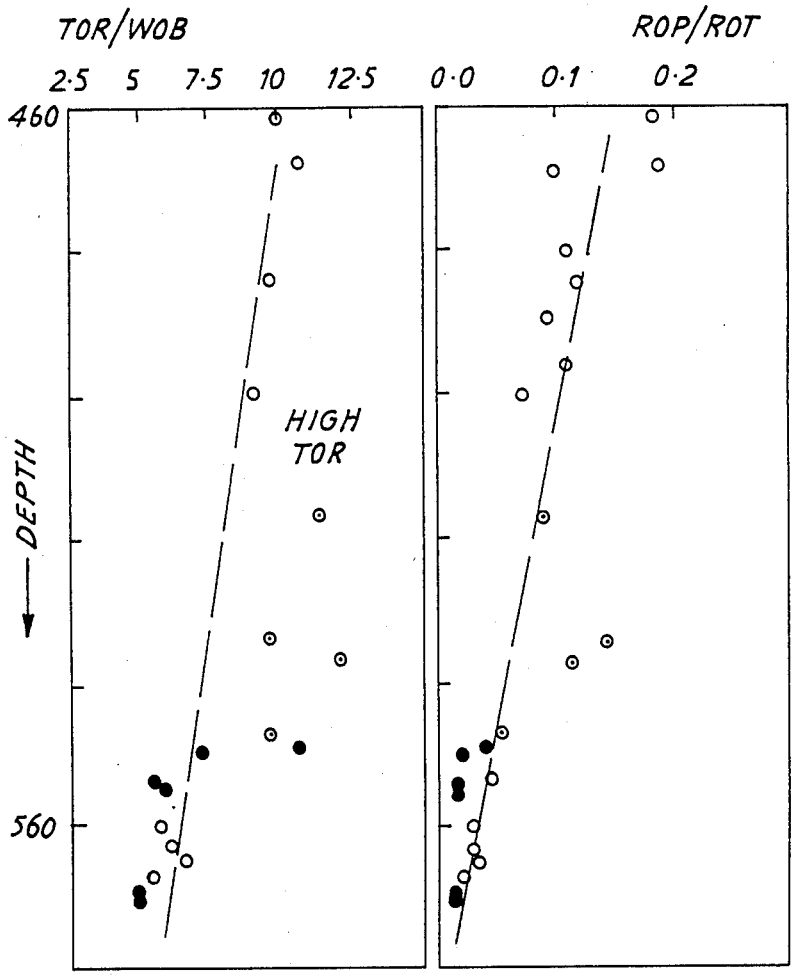
FIG. 2 represents plots of (TOR/WOB) and (ROP/ROT).
Figure 3:
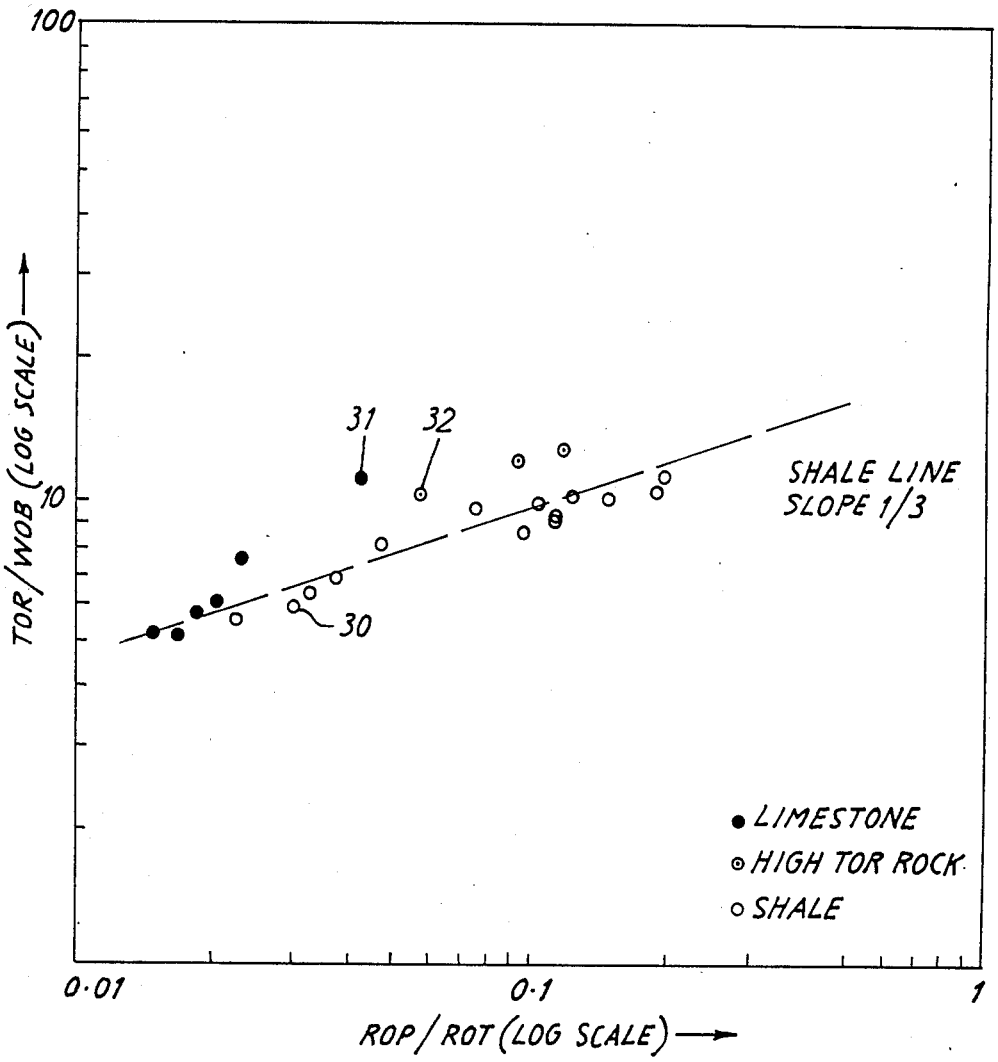
FIG. 3 is a graphical representation of a first depth history for the drilling operation of FIG. 1.

The TOR is plotted (FIG. 2) as the ratio (TOR/WOB) since this is proportional to the depth of drill bit tooth indentation and ROP is plotted as the penetration per revolution, (ROP/ROT). Both logs show a decreasing trend with depth with some anomalies between about 520 m and 550 m where the tooth penetration appears to be higher then the trend. These points might be attributed to some weaker rock. FIG. 3 is a log-log plot of (TOR/WOB) versus (ROP/ROT) and presents a first depth history of points (a, b) eg. point 30 computed in accordance with the present invention. An advantage of the (log-log plot) is that if the lithology is homogenous, points on the cross-plot define a straight line. The slope of this line being indicative of lithology type, also indicates the effective geometry of the system (i.e. the shape of the craters formed as a drill bit tooth impacts) since crater shape depends on the type of formation being drilled through. Points on the cross-plot corresponding to hard brittle rock, such as limestone, e.g. point 31 and high TOR layers e.g. point 32 can be identified and have been marked. The remaining points (soft plastic rock, e.g. shale) describe a definite trend towards the origin with a slope of $\frac{1}{3}$ and this value is indicative of down hole geometry.

Figure 4:
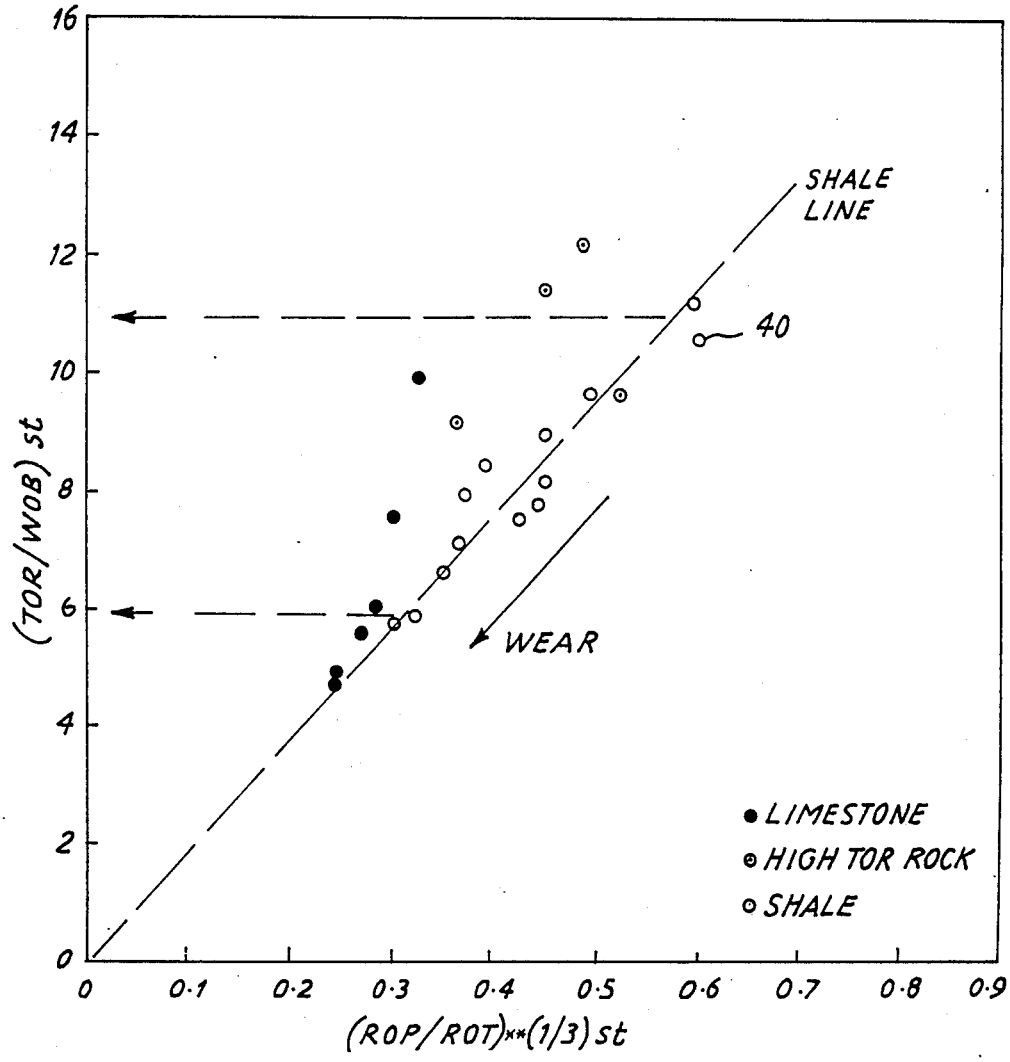
FIG. 4 is a graphical representation of a depth history for the drilling operation of FIG. 1 standardized for WOB variation.

Once the geometry of the system has been described and a value assigned to $\gamma$ it is possible to form the depth history, represented in FIG. 4 as plot of (TOR/WOB) against $(ROP/ROT)^{\frac{1}{3}}$ which is standardized for WOB variation. The trend in the points due to shale (e.g. point 40) may be monitored.

The presence of wear is clearly indicated by the trend towards the origin in those points corresponding to shale, and has thus been identified by real time computations. On the standardized (TOR/WOB) scale the variation in shale goes from approximately 11 to 6, showing that nearly half the length of the teeth when new has been worn away.

In order that the invention may be further appreciated, other examples will now be described, and are represented in graphical form for clarity.

Figure 5:
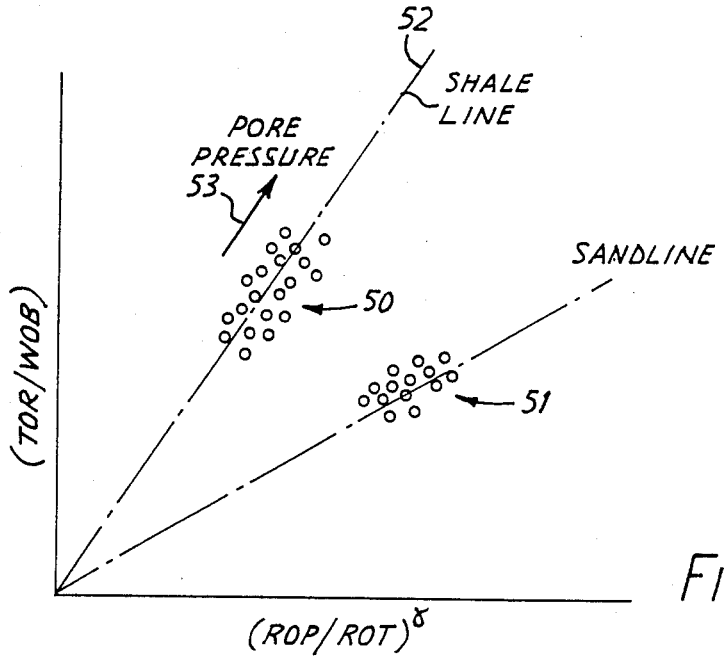
FIGS. 5 and 6 are graphical representations of further examples of typical depth histories.

FIG. 5 represents a depth history shown generally at 50 as would be expected for a drilling operation in shale, and a history 51 as would be expected for sand. Any trend to migration along the shale line 52, for example by the time history of point developing in direction 53, corresponds to changes in pore pressure because an increase in pore pressure usually results in an increase in the rate of penetration.

Figure 6:
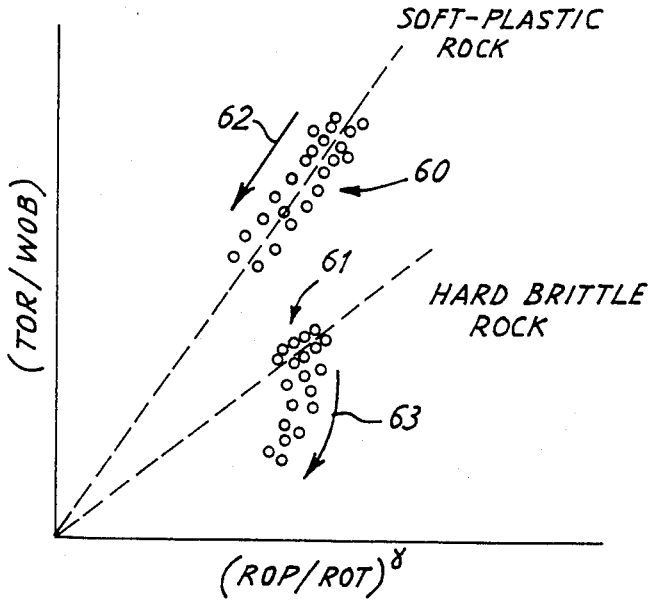

In FIG. 6 two times histories, 60 and 61 are plotted. In soft plastic rock 60 drill bit wear is indicated by migration 62 towards the origin; that is by reducing modulus at constant argument. In hard brittle rock 61 wear is indicated by migration 63 towards the abscissa; that is by reducing argument. It will be realized that the histories will be built up as layers of each type of rock are encountered during drilling.

In the examples presented above drilling is dominated by chipping and crushing. It will be understood that where the mechanism of drilling is different (e.g. gouging) different trends will be expected.

It will be appreciated that these trends, although represented graphically in the above examples, may be established by computation and comparison steps within a computer.

The matter for which the applicant seeks protection is:

1. A method of assessing drilling conditions during a hole drilling operation including the steps of:

gathering measurements of torque applied (TOR), weight on bit (WOB), rate of penetration (ROP), and rotation speed (ROT);

computing the values $x=(TOR/WOB)$ and $y=(ROP/ROT)^{\gamma}$ for substantially simultaneous samples of TOR, WOB, ROP and ROT; where $\gamma$ is a constant indicative of down hole geometry, building up a history of a plurality of points (x,y) in the (TOR/WOB) versus $(ROP/ROT)^{\gamma}$ plane; and monitoring trends in the history of points (x, y).

2. A method of assessing drilling conditions as claimed in claim 1 and including the additional steps of:

computing values $a=\log(TOR/WOB)$ and $b=\log(ROP/ROT)$ for substantially simultaneous samples of TOR, WOB, ROP and ROT;

building up a first history of a plurality points (a,b) in the log (TOR/WOB) versus log (ROP/ROT) plane, and interpreting the first history to identify the constant $\gamma$.

3. A method of assessing drilling conditions as claimed in claim 2 and including the step of standardizing the points (x, y) for varition in WOB.

4. A method of monitoring drilling conditions comprising the steps of:

measuring the torque required to rotate the bit (TOR), the weight on the bit (WOB), the rate of penetration (ROP), and the speed of rotation of the bit (ROT);

calculating the values $X=TOR/WOB$ and $Y=(ROB/ROT)^{\gamma}$, where $\gamma$ is a constant indicative of downhole geometry:

building up a history of a plurality of points (X,Y) in the (TOR/WOB) versus (ROP/ROT) plane; and from the direction the points X, Y take with respect to the origin as drilling progresses, monitoring a decrease in at least one of the values X and Y.

5. The method of claim 4 further including the steps of determining the slope of a line in a plot of log (TOR/WOB) and log (ROP/ROT) for a plurality of substantially simultaneously measured values of TOR, WOB, ROP, and ROT; and using said slope of the line as the exponent $\gamma$.

6. A method of assessing drilling conditions comprising the steps of:

measuring the torque required to rotate the bit (TOR), the weight on the bit (WOB), the rate of penetration (ROP), and speed of rotation of the bit (ROT);

for substantially simultaneous reading of TOR, WOB, ROP, and ROT, plotting log (ROP/ROT) versus log (TOR/WOB);

determining a quantity $\gamma$ equal to the slope of a straight line through the points in the plot of log (ROP/ROT) versus log (TOR/WOB);

plotting a plurality of points (X,Y) where $X=(TOR/WOB)$ and $Y=(ROB/ROT)^{\gamma}$;

monitoring a decrease in the value of at least one of the values X and Y, and pulling the bit when the decrease is substantial.

* * * * *